US011289038B2

(12) United States Patent
Sun et al.

(10) Patent No.: US 11,289,038 B2
(45) Date of Patent: Mar. 29, 2022

(54) PIXEL CHARGING METHOD FOR ADJUSTING SUB-PIXEL CHARGING TIME, PIXEL CHARGING CIRCUIT, DISPLAY DEVICE AND DISPLAY CONTROL METHOD

(71) Applicants: Beijing BOE Display Technology Co., Ltd., Beijing (CN); BOE TECHNOLOGY GROUP CO., LTD., Beijing (CN)

(72) Inventors: Zhihua Sun, Beijing (CN); Yinshu Zhang, Beijing (CN); Jian Li, Beijing (CN); Senwang Li, Beijing (CN); Guohuo Su, Beijing (CN); Jianhua Huang, Beijing (CN); Hui Zhang, Beijing (CN)

(73) Assignees: Beijing BOE Display Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 38 days.

(21) Appl. No.: 16/836,134

(22) Filed: Mar. 31, 2020

(65) Prior Publication Data

US 2021/0097946 A1 Apr. 1, 2021

(30) Foreign Application Priority Data

Sep. 30, 2019 (CN) ..... 201910940071.2

(51) Int. Cl.
*G09G 5/00* (2006.01)
*G09G 3/36* (2006.01)
*G09G 3/34* (2006.01)

(52) U.S. Cl.
CPC ..... *G09G 3/3607* (2013.01); *G09G 3/3406* (2013.01); *G09G 3/3611* (2013.01);
(Continued)

(58) Field of Classification Search
CPC .. G09G 3/3406; G09G 3/3607; G09G 3/3611; G09G 3/3648; G09G 2310/0251;
(Continued)

(56) References Cited

U.S. PATENT DOCUMENTS

2003/0058229 A1* 3/2003 Kawabe ..... G09G 3/342 345/204
2003/0122755 A1* 7/2003 Kim ..... G09G 3/342 345/87

(Continued)

FOREIGN PATENT DOCUMENTS

CN 101393727 A 3/2009
CN 101398553 A 4/2009

(Continued)

OTHER PUBLICATIONS

First Office Action for CN Patent Application No. 201910940071.2 dated Jan. 25, 2021.

*Primary Examiner* — Adam J Snyder
(74) *Attorney, Agent, or Firm* — Thomas | Horstemeyer, LLP

(57) ABSTRACT

The present disclosure relates to the field of display technology and, in particular, to a pixel charging method, a pixel charging circuit, a display device, and a display control method. The pixel charging method includes acquiring a state of a backlight source and adjusting a charging time of a sub-pixel corresponding to the backlight source according to the state of the backlight source. When the backlight source is in an on state, the charging time of the sub-pixel corresponding to the backlight source is a first charging time. When the backlight source is in an off state, the charging time of the sub-pixel corresponding to the backlight source is a second charging time, the second charging time being shorter than the first charging time.

16 Claims, 2 Drawing Sheets

(52) U.S. Cl.
CPC ... *G09G 3/3648* (2013.01); *G09G 2310/0251* (2013.01); *G09G 2320/064* (2013.01); *G09G 2320/0626* (2013.01); *G09G 2320/0633* (2013.01); *G09G 2320/0646* (2013.01)

(58) Field of Classification Search
CPC ... G09G 2320/0626; G09G 2320/0633; G09G 2320/0646; G90G 2320/064
See application file for complete search history.

(56) References Cited

U.S. PATENT DOCUMENTS

| | | | | |
|---|---|---|---|---|
| 2004/0113906 | A1 | 6/2004 | Lew et al. | |
| 2005/0146496 | A1* | 7/2005 | Nguyen | G09G 3/3406 345/102 |
| 2005/0259064 | A1* | 11/2005 | Sugino | G09G 3/342 345/102 |
| 2006/0139289 | A1* | 6/2006 | Yoshida | G09G 3/3648 345/98 |
| 2013/0070174 | A1* | 3/2013 | Yoshida | G09G 3/3648 349/41 |
| 2014/0078194 | A1* | 3/2014 | An | G09G 3/3611 345/691 |

FOREIGN PATENT DOCUMENTS

| | | | |
|---|---|---|---|
| CN | 105355182 | A | 2/2016 |
| CN | 106297712 | A | 1/2017 |
| CN | 107424572 | A | 12/2017 |
| CN | 108648706 | A | 10/2018 |
| CN | 112150974 | A | 12/2020 |
| TW | 200620194 | A | 6/2006 |

* cited by examiner

PIXEL CHARGING METHOD FOR ADJUSTING SUB-PIXEL CHARGING TIME, PIXEL CHARGING CIRCUIT, DISPLAY DEVICE AND DISPLAY CONTROL METHOD

CROSS-REFERENCE TO RELATED APPLICATION

This application is based upon and claims priority to Chinese Patent Application No. 201910940071.2, filed on Sep. 30, 2019, the entire contents thereof being incorporated herein by reference.

TECHNICAL FIELD

The present disclosure relates to the field of display technology and, in particular, to a pixel charging method, a pixel charging circuit, a display device, and a display control method.

BACKGROUND

A liquid crystal display (LCD) product has many advantages, such as a thin body, power saving features, no radiation, etc., and has been widely used in various products, such as LCD TVs, mobile phones, personal digital assistants (PDAs), digital cameras, computer screens or laptop screens, etc.

However, current liquid crystal display panels are prone to exhibit bright and dark stripes when displaying frames, which results in poor frame uniformity especially when displaying a static solid-color frame.

It should be noted that the information disclosed in the background section above is only used to enhance the understanding of the background of the present disclosure, and therefore, may include information that does not constitute the prior art known to those skilled in the art.

SUMMARY

The present disclosure provides a pixel charging method, a pixel charging circuit, a display device, and a display control method.

According to a first aspect of the present disclosure, a pixel charging method is provided, including: acquiring a state of a backlight source; and adjusting a charging time of a sub-pixel corresponding to the backlight source according to the state of the backlight source. When the backlight source is in an on state, the charging time of the sub-pixel corresponding to the backlight source is a first charging time; and when the backlight source is in an off state, the charging time of the sub-pixel corresponding to the backlight source is a second charging time, where the second charging time is shorter than the first charging time.

In an exemplary embodiment, the acquiring of a state of a backlight source includes: acquiring a pulse width modulation signal, the pulse width modulation signal being configured to control the state of the backlight source; and determining the state of the backlight source based on the pulse width modulation signal.

In an exemplary embodiment, the determining the state of the backlight source based on the pulse width modulation signal includes: determining that the backlight source is in the on state when the pulse width modulation signal is a high-level signal; and determining that the backlight source is in the off state when the pulse width modulation signal is a low-level signal.

In an exemplary embodiment, the acquiring a state of a backlight source includes: detecting brightness of the backlight source; determining that the backlight source is in the on state when the brightness of the backlight source is greater than a preset threshold; and determining that the backlight source is in the off state when the brightness of the backlight source is less than or equal to the preset threshold.

In an exemplary embodiment, the adjusting a charging time of a sub-pixel corresponding to the backlight source according to the state of the backlight source includes: adjusting a gate output enable time corresponding to the sub-pixel corresponding to the backlight source according to the state of the backlight source; and calculating the charging time corresponding to the gate output enable time based on a preset correspondence between the gate output enable time and the charging time. When the backlight source is in the on state, the gate output enable time corresponding to the sub-pixel corresponding to the backlight source is a first gate output enable time; and when the backlight source is in the off state, the gate output enable time corresponding to the sub-pixel corresponding to the backlight source is a second gate output enable time, and the second gate output enable time is greater than the first gate output enable time.

According to a second aspect of the present disclosure, there is provided a pixel charging circuit, including: a signal acquiring circuit, configured to acquire a state of a backlight source; and an adjusting circuit, coupled to the signal acquiring circuit and configured to adjust a charging time of a sub-pixel corresponding to the backlight source according to the state of the backlight source. The adjusting circuit is configured to adjust the charging time of the sub-pixel corresponding to the backlight source to be a first charging time when the backlight source is in an on state; and the adjusting circuit is configured to adjust the charging time of the sub-pixel corresponding to the backlight source to be a second charging time when the backlight source is in an off state, and the second charging time is shorter than the first charging time.

In an exemplary embodiment, wherein the signal acquiring circuit includes: a signal acquiring sub-circuit, coupled to a pulse width modulation circuit and configured to acquire a pulse width modulation signal generated by the pulse width modulation circuit, wherein the pulse width modulation signal is configured to control the state of the backlight source; and a first determining sub-circuit, coupled to the signal acquiring sub-circuit and the adjusting circuit, and configured to determine the state of the backlight source based on the pulse width modulation signal and transmit the state of the backlight source to the adjusting circuit.

In an exemplary embodiment, the first determining sub-circuit is configured to determine that the backlight source is in the on state when the pulse width modulation signal is a high-level signal, and determine that the backlight source is in the off state when the pulse width modulation signal is a low-level signal.

In an exemplary embodiment, the signal acquiring circuit includes: a brightness detecting sub-circuit, configured to detect brightness of the backlight source; and a second determining sub-circuit, configured to determine that the backlight source is in the on state when the brightness of the backlight source is greater than a preset threshold, and determine that the backlight source is in the off state when the brightness of the backlight source is less than or equal to the preset threshold.

In an exemplary embodiment, wherein the adjusting circuit includes: an adjusting sub-circuit, coupled to the signal acquiring circuit and configured to adjust a gate output enable time corresponding to the sub-pixel corresponding to the backlight source according to the state of the backlight source; and a calculating sub-circuit, coupled to the adjusting sub-circuit and configured to calculate the charging time corresponding to the gate output enable time based on a preset correspondence between the gate output enable time and the charging time. The adjusting sub-circuit is configured to adjust the gate output enable time corresponding to the sub-pixel corresponding to the backlight source to be a first gate output enable time when the backlight source is in the on state; and the adjusting sub-circuit is configured to adjust the gate output enable time corresponding to the sub-pixel corresponding to the backlight source to be a second gate output enable time when the backlight source is in the off state, and the second gate output enable time is longer than the first gate output enable time.

According to a third aspect of the present disclosure, there is provided a display device, including a display area and a non-display area, the display area includes a plurality of sub-pixels arranged in an array; and the non-display area includes anyone of the pixel charging circuits, and the pixel charging circuit is coupled to the sub-pixel.

According to a fourth aspect of the present disclosure, there is provided a display control method, applied to a display device. The display device includes a plurality of pixel display areas, each of the pixel display areas includes at least one row of sub-pixels, and the display control method includes: acquiring a state of a backlight source corresponding to each of the pixel display areas; and adjusting a charging time of a sub-pixel corresponding to the backlight source according to the state of the backlight source. When the backlight source is in an on state, the charging time of the sub-pixel corresponding to the backlight source is a first charging time; and when the backlight source is in an off state, the charging time of the sub-pixel corresponding to the backlight source is a second charging time, and the second charging time is shorter than the first charging time.

It should be understood that the above general description and the following detailed description are merely exemplary and explanatory, and should not limit the present disclosure.

BRIEF DESCRIPTION OF THE DRAWINGS

The drawings herein are incorporated in and constitute a part of the specification, illustrate embodiments consistent with the present disclosure, and together with the description serve to explain the principles of the present disclosure. Understandably, the drawings in the following description are just some embodiments of the present disclosure. For those of ordinary skill in the art, other drawings can be obtained according to these drawings without creative efforts.

DETAILED DESCRIPTION

Figure 1:
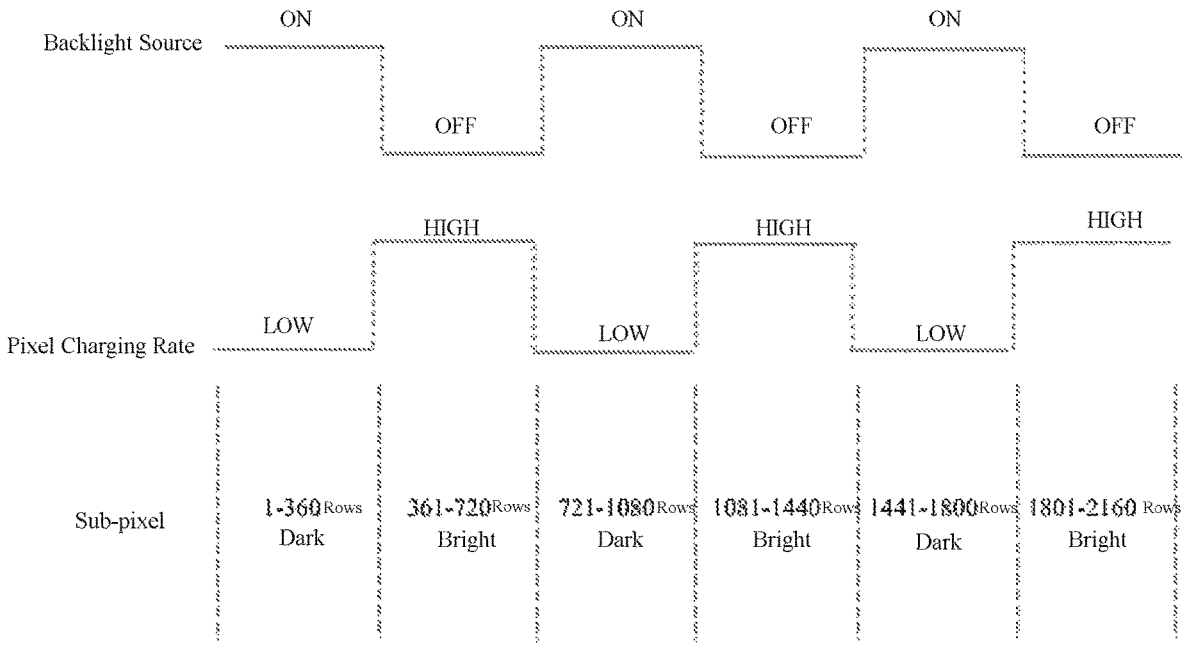
FIG. 1 is a schematic diagram showing a correspondence among a state of a backlight source, a pixel charging rate, and a bright-dark state of a sub-pixel within one frame time in the related art.

Example embodiments will now be described more fully with reference to the accompanying drawings. However, the example embodiments may be implemented in various forms and should not be construed as being limited to the embodiments set forth herein. Rather, these embodiments are provided so that the present disclosure will be comprehensive and complete, and will fully convey the concepts of the example embodiments to those skilled in the art. The same reference numerals in the drawings denote the same or similar structures, and thus their detailed descriptions will be omitted.

Although relative terms, such as "on" and "under," are used in this specification to describe a relative relationship between one component and another component shown in the drawings, these terms are used in this specification for convenience only, for example, according to the direction of the examples described in the drawings. It can be understood that if the device shown in the drawings is turned upside down, the component described "on" will become the component "below." When a structure is "on" another structure, it may mean that the structure is integrally formed on the another structure, or that the structure is "directly" provided on the another structure, or that the structure is "indirectly" provided on the another structure through an other structure.

Compared with a cold cathode fluorescent lamp (CCFL) light source, a light emitting diode (LED) light source has advantages such as low power consumption, long life and high brightness, and thus, more and more liquid crystal displays devices (especially large-size liquid crystal display devices) started using the LED light sources as backlight sources. At the same time, in order to further improve a contrast of and thus a display quality of a liquid crystal display frame, the LED light source, when being used as the backlight source of the liquid crystal display device, can be adjusted by a backlight source adjusting technology.

LED backlight adjusting technologies currently used include an LED analog backlight-adjusting technology and a pulse width modulation (PWM) backlight-adjusting technology. However, when the LED analog backlight-adjusting technology is used to adjust the LED light source, it is usually implemented by directly changing current flowing through the LED, which will seriously affect luminous quality of the LED. Moreover, the use of analog backlight-adjusting technology will often increase energy consumption of an entire system. Therefore, the PWM backlight-adjusting technology is mostly used in the LED backlight source driving of the liquid crystal display device (especially the large-size liquid crystal display device).

The PWM backlight-adjusting technology is a backlight-adjusting technology that uses a simple pulse signal to repeatedly turn on and off an LED driver. The PWM backlight-adjusting technology controls brightness of a backlight LED by adjusting a frequency and a duty cycle of the pulse signal. A modulation frequency of a PWM signal may be an integer multiple of a matched frame frequency of a display panel, and the display panel can be scanned row by row.

Since the display panel is scanned row by row, when one frame is displayed, a part of the sub-pixels on the display panel are scanned while the backlight source is in an on state, and the other part of the sub-pixels are scanned while the backlight source is in an off state. For example, as shown in FIG. 1, within one frame time, the backlight has 3 changing-cycles, and 2160 rows of sub-pixels (excluding blanking areas) of the display panel are scanned. According to the backlight cycle, the 2160 rows of sub-pixels can be divided into 6 pixel display areas, that is, each of pixel display area includes 360 rows of sub-pixels and corresponds to a periodic on or off state of the backlight source.

It should be noted that when the backlight source is in the off state (corresponding to OFF in FIG. 1), an active layer (made of semiconductor material) in a corresponding pixel circuit to the backlight source can be understood as an insulating layer, and in this case, a dielectric constant thereof may be $\epsilon_1$. When the backlight source is in the on state (corresponding to ON in FIG. 1), the active layer (made of the semiconductor material) in the corresponding pixel circuit to the backlight source will become an electrical conductor under light irradiation, and in this case, the dielectric constant thereof may be $\epsilon_2$, where $\epsilon_2$ is greater than $\epsilon_1$. Based on the capacitance calculation formula $C=\epsilon S/d$, it can be seen that when a distance d and an opposite area S between the active layer and a gate is constant, the larger the dielectric constant $\epsilon$, the larger the capacitance C generated between the active layer and the gate is. The larger the capacitance C, the more serious the time delay is, which will reduce a pixel charging rate so that the brightness of a corresponding pixel is relatively lower.

That is, as shown in FIG. 1, the charging rate of the sub-pixel scanned when the backlight source is in the on state is lower than that of the sub-pixel scanned when the backlight source is in the off state. Therefore, bright and dark stripes are exhibited due to different charging rates when a frame is displayed, and the uniformity of the frame is not good, especially when a static solid-color frame is displayed.

In order to solve the above problem, the inventors proposes a solution, in which a modulation frequency of a backlight source is increased, that is, to 15 KHz. When the modulation frequency of the backlight source is increased to 15 KHz, human eyes can't distinguish the bright and dark stripes. However, since the frequency is too large, the service life of an LED will be greatly reduced, and thus this solution does not fundamentally solve this problem.

Based on the foregoing, the inventors provide another solution, and specifically provides a pixel charging method.

Figure 2:
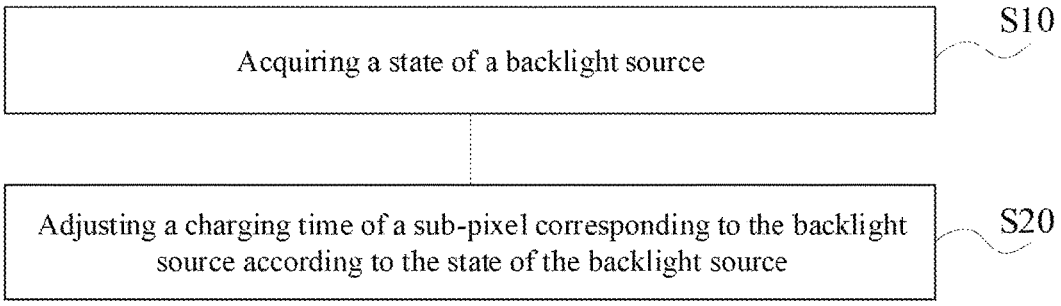
FIG. 2 shows a flowchart of a pixel charging method according to an embodiment of the present disclosure.

As shown in FIG. 2, the pixel charging method includes: step S10, acquiring a state of a backlight source; and step S20, adjusting a charging time of a sub-pixel corresponding to the backlight source according to the state of the backlight source. When the backlight source is in an on state, the charging time of the sub-pixel corresponding to the backlight source is a first charging time; and when the backlight source is in an off state, the charging time of the sub-pixel corresponding to the backlight source is a second charging time, and the second charging time is shorter than the first charging time.

In this embodiment, the state of the backlight source is acquired, and the charging time of the sub-pixel corresponding to the backlight source is adjusted according to the state of the backlight source. Specifically, the charging time of the sub-pixel corresponding to the backlight source when the backlight source is in the on state shall be longer than the charging time of the sub-pixel corresponding to the backlight source when the backlight source is in the off state, which can increase the charging rate of the sub-pixel when the backlight source is in the on state, so that the charging rates of the sub-pixels are substantially the same when corresponding backlight sources are in different states. Therefore, it can ensure that display brightness of the sub-pixels is subtantially uniform when the corresponding backlight sources are in the different states, and then it can prevent a single sub-pixel from flickering when the state of the backlight source is changed. In addition, when a frame is displayed, charging effects of the sub-pixel corresponding to the different states of the backlight source is substantially the same, that is, the brightness thereof is substantially the same, which can prevent bright and dark stripes from exhibiting on one frame, and then can ensure the uniformity of the frame, thereby improve the display effect.

It should be understood that the backlight source of this embodiment may be an LED backlight source.

As described above, the state of the backlight source may be adjusted by the PWM backlight-adjusting technology. Therefore, in an embodiment, the acquiring a state of a backlight source may specifically include: step S102, acquiring a pulse width modulation signal (i.e., a PWM signal), the pulse width modulation signal being configured to control the state of the backlight source; and step S104, determining the state of the backlight source based on the pulse width modulation signal.

For example, when the pulse width modulation signal is a high-level signal, it can be determined that the backlight source is in the on state; and when the pulse width modulation signal is a low-level signal, it can be determined that the backlight source is in the off state. However, the present disclosure is not limited thereto. For example, when the pulse width modulation signal is the low-level signal, it can be determined that the backlight source is in the on state; and when the pulse width modulation signal is the high-level signal, it can be determined that the backlight source is in the off state, which depends on a specific situation.

It shall be noted that the present disclosure is not limited to determining the state of the backlight source by acquiring the pulse width modulation signal. In an embodiment, the state of the backlight source may be determined by directly detecting brightness of the backlight source, which may specifically include: step S112, detecting the brightness of the backlight source; step S114, determining that the backlight source is in the on state when the brightness of the backlight source is greater than a preset threshold; and step S116, determining that the backlight source is in the off state when the brightness of the backlight source is less than or equal to the preset threshold.

It should be understood that this preset threshold may be set according to specific situations.

A duration of a gate drive signal corresponding to the sub-pixel is a sum of the charging time of the sub-pixel and a gate output enable time (i.e., GOE time) corresponding to the sub-pixel. The GOE time is a time taken for the gate drive signal to shift from a high-level to a low-level or the time taken for the gate drive signal to shift from the low-level to the high-level. The pixel cannot be charged within the GOE time.

Since the duration of the gate drive signal corresponding to the sub-pixel is determined, in order to adjust the charging time of the sub-pixel, the GOE time corresponding to the sub-pixel can be adjusted. That is, in an embodiment, the adjusting a charging time of a sub-pixel corresponding to the backlight source according to the state of the backlight source may specifically include: step S202, adjusting the gate output enable time corresponding to the sub-pixel corresponding to the backlight source according to the state of the backlight source; and step S204, calculating the charging time corresponding to the gate output enable time based on a preset correspondence between the gate output enable time and the charging time.

When the backlight source is in the on state, the gate output enable time corresponding to the sub-pixel corresponding to the backlight source is a first gate output enable time. When the backlight source is in the off state, the gate output enable time corresponding to the sub-pixel corresponding to the backlight source is a second gate output enable time. The second gate output enable time is greater than the first gate output enable time.

It should be noted that the preset correspondence between the gate output enable time and the charging time described above is that the sum of the gate output enable time and the charging time is equal to the duration of the gate drive signal.

For example, when designing a product, an optimal GOE time (assuming A) is set according to a simulation experiment, the GOE time is controlled according to the backlight state by setting a gain coefficient value (assuming B), and then the charging rate of sub-pixel is controlled. Specifically, when the backlight state is in the off state, the charging rate of the sub-pixel is good. At this time, the actual GOE time T1 corresponding to the sub-pixel may be A×B×C1, and the C1 may be 100%; when the state of the backlight source is in the on state, the charging rate of the sub-pixel is poor, that is, it is lower than the charging rate when the backlight source is in the off state. Therefore, in order to increase the charging rate of the sub-pixel when the backlight source is in the on state to be the same as the charging rate when the backlight source is in the off state, the GOE time may be shortened. That is, at this time, the actual GOE time T2 corresponding to the sub-pixel may be A×B×C2, and the C2 is less than C1, for example, the C2 may be 90%, 80%, 70% and so on. It should be noted that the value of C2 may be determined by measuring the brightness of different products, and be controlled separately according to the different products.

Based on the pixel charging method described in the foregoing embodiments, an embodiment of the present disclosure further provides a pixel charging circuit 30.

Figure 3:
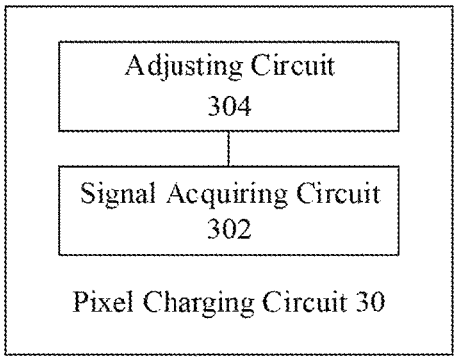
FIG. 3 is a block diagram of a pixel charging circuit according to an embodiment of the present disclosure.

As shown in FIG. 3, the pixel charging circuit 30 includes: a signal acquiring circuit 302, configured to acquire a state of a backlight source; and an adjusting circuit 304, coupled to the signal acquiring circuit 302 and configured to adjust a charging time of a sub-pixel corresponding to the backlight source according to the state of the backlight source.

The adjusting circuit 304 is configured to adjust the charging time of the sub-pixel corresponding to the backlight source to be a first charging time when the backlight source is in an on state.

The adjusting circuit 304 is configured to adjust the charging time of the sub-pixel corresponding to the backlight source to be a second charging time when the backlight source is in an off state, and the second charging time is shorter than the first charging time.

In an embodiment, the signal acquiring circuit 302 may include: a signal acquiring sub-circuit, coupled to a pulse width modulation circuit and configured to acquire a pulse width modulation signal generated by the pulse width modulation circuit, wherein the pulse width modulation signal is configured to control the state of the backlight source; and a first determining sub-circuit, coupled to the signal acquiring sub-circuit, and configured to determine the state of the backlight source based on the pulse width modulation signal.

For example, the first determining sub-circuit is configured to determine that the backlight source is in the on state when the pulse width modulation signal is a high-level signal; and determine that the backlight source is in the off state when the pulse width modulation signal is a low-level signal. However, the present disclosure is not limited thereto. The first determining sub-circuit may also be configured to determine that the backlight source is in the on state when the pulse width modulation signal is the low-level signal; and determine that the backlight source is in the off state when the pulse width modulation signal is the high-level signal, which depends on the specific situation.

In another embodiment, the signal acquiring circuit 302 may include: a brightness detecting sub-circuit, configured to detect brightness of the backlight source; and a second determining sub-circuit, configured to determine that the backlight source is in the on state when the brightness of the backlight source is greater than a preset threshold, and determine that the backlight source is in the off state when the brightness of the backlight source is less than or equal to the preset threshold.

In an embodiment, the adjusting circuit 304 may include: an adjusting sub-circuit, coupled to the signal acquiring circuit 302 and configured to adjust a gate output enable time corresponding to the sub-pixel corresponding to the backlight source according to the state of the backlight source; and a calculating sub-circuit, coupled to the adjusting sub-circuit and configured to calculate the charging time corresponding to the gate output enable time based on a preset correspondence between the gate output enable time and the charging time.

The adjusting sub-circuit is configured to adjust the gate output enable time corresponding to the sub-pixel corresponding to the backlight source to be a first gate output enable time when the backlight source is in the on state.

The adjusting sub-circuit is configured to adjust the gate output enable time corresponding to the sub-pixel corresponding to the backlight source to be a second gate output enable time when the backlight source is in the off state, and the second gate output enable time is longer than the first gate output enable time.

Figure 4:
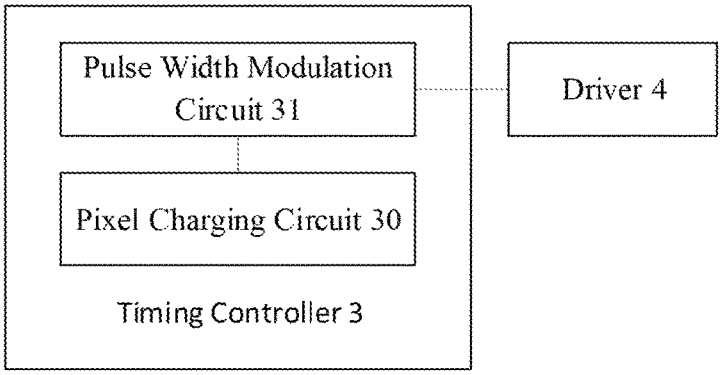
FIG. 4 is a schematic diagram illustrating a connection between a timing controller and a driver for driving a backlight source according to an embodiment of the present disclosure.

For example, as shown in FIG. 4, the pixel charging circuit 30 described in the embodiment of the present disclosure may be part of a timing controller 3, and the aforementioned pulse width modulation circuit 31 may also be part of the timing controller 3.

Specifically, the pixel charging circuit 30 in the timing controller 3 may be coupled to the pulse width modulation circuit 31, and the pulse width modulation circuit 31 may also be coupled to a driver 4 of an LED backlight source. The pulse width modulation circuit 31 may control an on/off state of the LED backlight source by controlling the driver 4. While the pulse width modulation circuit 31 controls the on/off state of the LED backlight source, the pixel charging circuit 30 may obtain a modulation signal generated by the pulse width modulation circuit 31, and according to the modulation signal, automatically adjust a GOE time, thereby adjusting the pixel charging rate, so that a display product has uniform brightness under different backlight frequencies, which avoids incontinuity of the frame, and thus improves uniformity of the frame.

The present disclosure further provides a display control method for a display device. The display device may include a plurality of pixel display areas, and each pixel display area includes at least one row of sub-pixels. The display control method may include: step S50, acquiring a state of a backlight source corresponding to each of the pixel display areas; and step S60, adjusting a charging time of a sub-pixel corresponding to the backlight source according to the state of the backlight source.

When the backlight source is in an on state, the charging time of the sub-pixel corresponding to the backlight source is a first charging time.

When the backlight source is in an off state, the charging time of the sub-pixel corresponding to the backlight source is a second charging time, and the second charging time is shorter than the first charging time.

The specific acquring method of step S50 may refer to the specific acquring method of step S10, and the specific adjusting method of step S60 may refer to the specific adjusting method of step S20, which is not described again in this embodiment.

It should be noted that a plurality of backlight sources may be provided correspondingly in each pixel display area. The states of the plurality of backlight sources in each pixel display area shall be consistent, and the states of backlight sources in different pixel display areas are adapted to be changed periodically.

Figure 5:
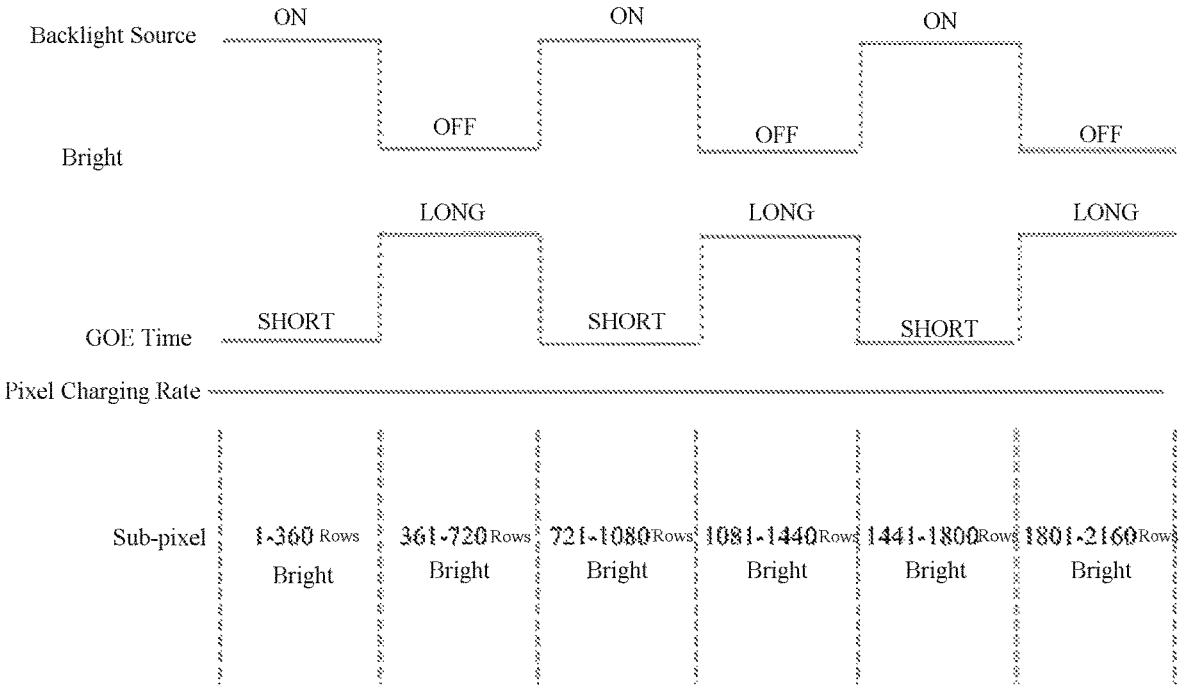
FIG. 5 is a schematic diagram illustrating a correspondence among a state of a backlight source, a GOE time length, a pixel charging rate, and a bright-dark state of a sub-pixel within one frame time according to an embodiment of the present disclosure.

For example, as shown in FIG. 5, whithin one frame time, the backlight has 3 cycles, and 2160 rows of sub-pixels (excluding blanking areas) of a display panel are scanned. According to the backlight cycle, the 2160 rows of sub-pixels is divided into 6 pixel display areas, that is, each of pixel display area includes 360 rows of sub-pixels and corresponds to a periodic on or off state of the backlight source. An GOE time corresponding to the sub-pixel corresponding to the backlight source in the on state (corresponding to ON in FIG. 5) shall be shorter than the GOE time corresponding to the sub-pixel corresponding to the backlight source in the off state (corresponding to OFF in FIG. 5), so that the charging rate of the sub-pixel corresponding to different states of the backlight source is substantially the same, that is, the brightness thereof is substantially the same, which can prevent bright and dark stripes from exhibiting on one frame and avoid incontinuity of the frame, and then can ensure the uniformity of the frame, thereby improving the display effect.

The present disclosure also provides a display device having a display area and a non-display area. The display area includes a plurality of sub-pixels arranged in an array, and the non-display area includes the pixel charging circuit described in any of the foregoing embodiments. The pixel charging circuit is coupled to the sub-pixel.

In addition, the display device may further include a backlight module. The backlight module includes a plurality of backlight sources, and the backlight sources may correspond to the sub-pixels.

According to the embodiment of the present disclosure, the specific type of the display device is not particularly limited, and the display device may be of any type commonly used in the art, for example, may be a liquid crystal display device such as televisions, computers, mobile phones, watches, etc. The specific type may be selected correspondingly by those skilled in the art according to a specific application of the display device, which is not repeated herein.

The terms "a", "an", "the" and "said" are used to indicate the presence of one or more elements/components/etc.; the terms "include" and "having" are used to include open-ended inclusive meaning and means that there may be additional elements/components/etc. in addition to the listed elements/components/etc.; the terms "first", "second", etc. are only used as markers, and are not used to limit the number of their objects.

Those skilled in the art will readily contemplate other embodiments of the present disclosure after considering the specification and practicing the invention disclosed herein. This disclosure is intended to cover any variations, uses, or adaptations of this disclosure. These variations, uses, or adaptations follow the general principles of this disclosure and include common general knowledge or conventional technical means in the technical field not disclosed in this disclosure. It is intended that the specification and examples are considered as exemplary only, with a true scope and spirit of the disclosure being indicated by the following claims.

What is claimed is:

1. A pixel charging method, comprising:

acquiring a state of a backlight source; and adjusting a charging time of a sub-pixel corresponding to the backlight source according to the state of the backlight source, wherein:

when the state of the backlight source is an on state, the charging time of the sub-pixel corresponding to the backlight source is a first charging time;

when the state of the backlight source is an off state, the charging time of the sub-pixel corresponding to the backlight source is a second charging time, the second charging time is shorter than the first charging time, so that when a frame is displayed, a charging rate of the sub-pixel when the state of the backlight source is the on state is substantially same as that of the sub-pixel when the state of the backlight source is the off state, the charging time of the sub-pixel is a difference between a duration of a gate drive signal corresponding to the sub-pixel and a gate output enable (GOE) time corresponding to the sub-pixel, and the GOE time is a time taken for the gate drive signal to shift from a high-level to a low-level or a time taken for the gate drive signal to shift from the low-level to the high-level.

2. The pixel charging method according to claim 1, wherein acquiring the state of the backlight source comprises:

acquiring a pulse width modulation signal, the pulse width modulation signal being configured to control the state of the backlight source; and determining the state of the backlight source based on the pulse width modulation signal.

3. The pixel charging method according to claim 2, wherein determining the state of the backlight source based on the pulse width modulation signal comprises:

determining that the state of the backlight source is the on state when the pulse width modulation signal is a high-level signal; and determining that the state of the backlight source is the off state when the pulse width modulation signal is a low-level signal.

4. The pixel charging method according to claim 1, wherein acquiring the state of the backlight source comprises:

detecting a brightness of the backlight source;

determining that the state of the backlight source is the on state when the brightness of the backlight source is greater than a threshold; and determining that the state of the backlight source is the off state when the brightness of the backlight source is less than or equal to the threshold.

5. The pixel charging method according to claim 1, wherein adjusting the charging time of the sub-pixel corresponding to the backlight source according to the state of the backlight source comprises:

adjusting the gate output enable time corresponding to the sub-pixel corresponding to the backlight source according to the state of the backlight source; and calculating the charging time corresponding to the gate output enable time based on a correspondence between the gate output enable time and the charging time, wherein:

when the state of the backlight source is the on state, the gate output enable time corresponding to the sub-pixel corresponding to the backlight source is a first gate output enable time; and when the state of the backlight source is the off state, the gate output enable time corresponding to the sub-pixel corresponding to the backlight source is a second gate output enable time, and the second gate output enable time is greater than the first gate output enable time.

6. A pixel charging circuit, comprising:

a signal acquiring circuit configured to acquire a state of a backlight source; and an adjusting circuit coupled to the signal acquiring circuit and configured to adjust a charging time of a sub-pixel corresponding to the backlight source according to the state of the backlight source, wherein:

the adjusting circuit is configured to adjust the charging time of the sub-pixel corresponding to the backlight source to be a first charging time when the state of the backlight source is an on state; and the adjusting circuit is configured to adjust the charging time of the sub-pixel corresponding to the backlight source to be a second charging time when the state of the backlight source is an off state, the second charging time is shorter than the first charging time, so that when a frame is displayed, a charging rate of the sub-pixel when the state of the backlight source is the on state is substantially same as that of the sub-pixel when the state of the backlight source is the off state, the charging time of the sub-pixel is a difference between a duration of a gate drive signal corresponding to the sub-pixel and a gate output enable (GOE) time corresponding to the sub-pixel, and the GOE time is a time taken for the gate drive signal to shift from a high-level to a low-level or a time taken for the gate drive signal to shift from the low-level to the high-level.

7. The pixel charging circuit according to claim 6, wherein the signal acquiring circuit comprises:

a signal acquiring sub-circuit coupled to a pulse width modulation circuit and configured to acquire a pulse width modulation signal generated by the pulse width modulation circuit, wherein the pulse width modulation signal is configured to control the state of the backlight source; and a first determining sub-circuit coupled to the signal acquiring sub-circuit and the adjusting circuit, and configured to determine the state of the backlight source based on the pulse width modulation signal and transmit the state of the backlight source to the adjusting circuit.

8. The pixel charging circuit according to claim 7, wherein the first determining sub-circuit is configured to determine that the state of the backlight source is the on state when the pulse width modulation signal is a high-level signal, and determine that the state of the backlight source is the off state when the pulse width modulation signal is a low-level signal.

9. The pixel charging circuit according to claim 6, wherein the signal acquiring circuit comprises:

a brightness detecting sub-circuit configured to detect brightness of the backlight source; and a second determining sub-circuit configured to determine that the state of the backlight source is the on state when the brightness of the backlight source is greater than a threshold, and determine that the state of the backlight source is the off state when the brightness of the backlight source is less than or equal to the threshold.

10. The pixel charging circuit according to claim 6, wherein the adjusting circuit comprises:

an adjusting sub-circuit, coupled to the signal acquiring circuit and configured to adjust the gate output enable time corresponding to the sub-pixel corresponding to the backlight source according to the state of the backlight source; and a calculating sub-circuit, coupled to the adjusting sub-circuit and configured to calculate the charging time corresponding to the gate output enable time based on a correspondence between the gate output enable time and the charging time, wherein:

the adjusting sub-circuit is configured to adjust the gate output enable time corresponding to the sub-pixel corresponding to the backlight source to be a first gate output enable time when the state of the backlight source is the on state; and the adjusting sub-circuit is configured to adjust the gate output enable time corresponding to the sub-pixel corresponding to the backlight source to be a second gate output enable time when the state of the backlight source is the off state, and the second gate output enable time is longer than the first gate output enable time.

11. A display device, comprising:

a display area and a non-display area, wherein:

the display area comprises a plurality of sub-pixels arranged in an array; and the non-display area comprises the pixel charging circuit according to claim 6, and the pixel charging circuit is coupled to the sub-pixel.

12. The display device according to claim 11, wherein the signal acquiring circuit comprises:

a signal acquiring sub-circuit coupled to a pulse width modulation circuit and configured to acquire a pulse width modulation signal generated by the pulse width modulation circuit, wherein the pulse width modulation signal is configured to control the state of the backlight source; and a first determining sub-circuit coupled to the signal acquiring sub-circuit and the adjusting circuit, and configured to determine the state of the backlight source based on the pulse width modulation signal and transmit the state of the backlight source to the adjusting circuit.

13. The display device according to claim 12, wherein the first determining sub-circuit is configured to determine that the state of the backlight source is the on state when the pulse width modulation signal is a high-level signal, and determine that the state of the backlight source is the off state when the pulse width modulation signal is a low-level signal.

14. The display device according to claim 11, wherein the signal acquiring circuit comprises:

a brightness detecting sub-circuit configured to detect brightness of the backlight source; and a second determining sub-circuit configured to determine that the state of the backlight source is the on state when the brightness of the backlight source is greater than a threshold, and determine that the state of the backlight source is the off state when the brightness of the backlight source is less than or equal to the threshold.

15. The display device according to claim 11, wherein the adjusting circuit comprises:

an adjusting sub-circuit coupled to the signal acquiring circuit and configured to adjust the gate output enable time corresponding to the sub-pixel corresponding to the backlight source according to the state of the backlight source; and a calculating sub-circuit coupled to the adjusting sub-circuit and configured to calculate the charging time corresponding to the gate output enable time based on a correspondence between the gate output enable time and the charging time, wherein:

the adjusting sub-circuit is configured to adjust the gate output enable time corresponding to the sub-pixel corresponding to the backlight source to be a first gate output enable time when the state of the backlight source is the on state; and the adjusting sub-circuit is configured to adjust the gate output enable time corresponding to the sub-pixel corresponding to the backlight source to be a second gate output enable time when the state of the backlight source is the off state, and the second gate output enable time is longer than the first gate output enable time.

16. A display control method applied to a display device, comprising:

providing the display device, wherein the display device comprises a plurality of pixel display areas, each of the pixel display areas comprising at least one row of sub-pixels;

acquiring a state of a backlight source corresponding to each of the pixel display areas; and adjusting a charging time of a sub-pixel corresponding to the backlight source according to the state of the backlight source, wherein:

when the state of the backlight source is an on state, the charging time of the sub-pixel corresponding to the backlight source is a first charging time; and when the state of the backlight source is an off state, the charging time of the sub-pixel corresponding to the backlight source is a second charging time, the second charging time is shorter than the first charging time, so that when a frame is displayed, a charging rate of the sub-pixel when the state of the backlight source is the on state is substantially same as that of the sub-pixel when the state of the backlight source is the off state, the charging time of the sub-pixel is a difference between a duration of a gate drive signal corresponding to the sub-pixel and a gate output enable (GOE) time corresponding to the sub-pixel, and the GOE time is a time taken for the gate drive signal to shift from a high-level to a low-level or a time taken for the gate drive signal to shift from the low-level to the high-level.

* * * * *